United States Patent [19]

Shibue et al.

[11] 4,363,871

[45] Dec. 14, 1982

[54] LIGHT-SENSITIVE PHOTOGRAPHIC MATERIAL

[75] Inventors: Toshiaki Shibue; Koichi Nagayasu; Tohru Kobayashi; Kouji Tokitou, all of Hino, Japan

[73] Assignee: Konishiroku Photo Industry Co., Ltd., Tokyo, Japan

[21] Appl. No.: 257,994

[22] Filed: Apr. 27, 1981

[30] Foreign Application Priority Data

May 13, 1980 [JP] Japan ..... 55-62317

[51] Int. Cl.[3] ..... G03C 1/78

[52] U.S. Cl. ..... 430/523; 430/527; 430/533; 430/961; 430/631; 430/529; 430/495; 430/564; 430/531; 430/534; 430/535; 430/536

[58] Field of Search ..... 430/527, 961, 529, 631, 430/627, 533, 551, 531, 523, 495, 564, 534, 535, 536; 260/DIG. 17

[56] References Cited

U.S. PATENT DOCUMENTS

| | | | |
|---|---|---|---|
| 3,888,944 | 6/1975 | Crescentini et al. | 260/DIG. 17 |
| 4,255,515 | 3/1981 | Shibue et al. | 430/961 |
| 4,268,623 | 5/1981 | Sera et al. | 430/529 |

FOREIGN PATENT DOCUMENTS

| | | | |
|---|---|---|---|
| 52-36021 | 3/1977 | Japan | 430/961 |

*Primary Examiner*—Won H. Louie, Jr.

*Attorney, Agent, or Firm*—Frishauf, Holtz, Goodman & Woodward

[57] ABSTRACT

A multi-layer light-sensitive photographic material comprising a support and a light-sensitive layer, which have a surface layer which does not adhere even under a high temperature and high humidity conditions when the front surface layer thereof is contacted with the other surface layer and which is hardly subject to scratching and free from the so-called "blooming" phenomenon.

The light-sensitive material according to this invention comprises, in at least one of the front and back sides thereof, at least one light-insensitive layer containing a high polymer having at least 20% by weight of a repeating unit represented by the formula (I):

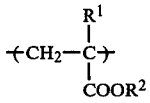

wherein $R^1$ represents a hydrogen atom or a methyl group, and $R^2$ represents a straight chain alkyl group having 12 to 24 carbon atoms.

16 Claims, No Drawings

LIGHT-SENSITIVE PHOTOGRAPHIC MATERIAL

The present invention relates to a physically improved light-sensitive photographic material, and particularly to a light-sensitive photographic material which is characterized in that a certain high polymer is applied to improve the properties of the surface of the photographic material, such as the antistatic property, the scratch resistant property and the adhesion resistant property (e.g., to avoid adhesion or sticking of the front and back surfaces of the light-sensitive photographic material).

In the production procedures such as coating, drying or processing, or during the handling such as winding, unwinding or transportation at the time of its use such as shooting, developing, printing or projecting, the light-sensitive photographic material is subject to receive undesirable influences through contact or friction with various substances, or through frictional or intimate contact with itself, e.g. contact of the front surface and the back surface of the light-sensitive material.

There have hitherto been various proposals to obtain a physically improved light-sensitive photographic material by increasing the scratch resistant strength of the photographic element layer of the light-sensitive photographic material or by reducing the sliding friction of the light-sensitive photographic material so that the light-sensitive photographic material will not receive damage during the production operation, the developing treatment or the printing operation, and a normal print will be obtained without diffused reflection due to scratches at the time of printing on photographic paper. For instance, there have been known a method for increasing the scratch resistant strength by adding a gelatin film hardening agent to the photographic element layer (see British Pat. No. 1,270,578); a method to impart a slipping property to the light-sensitive photographic material by incorporating both dimethyl silicon and a certain surface active agent into the photographic emulsion layer or the protecting layer (see U.S. Pat. No. 3,042,522); a method to impart a slipping property by coating a mixture of dimethyl silicon and diphenyl silicon on the back surface of the support of the light-sensitive photographic material (see U.S. Pat. No. 3,080,317); a method to impart a slipping property to the light-sensitive photographic material by incorporating triphenyl terminal blocked methylphenyl silicone into the protecting layer (see British Pat. No. 1,143,118); a method to impart a slipping property to the light-sensitive photographic material by incorporating a wax-type cetyl palmitate (see West German Pat. No. 1,300,015); a method for employing a polyester derived from an aliphatic dicarboxylic acid and an aliphatic or alicyclic diol as a slipping agent for the top layer of the photographic element layer (see Japanese Laid-Open Patent Application No. 31217/1976); a method to impart a slipping property to a light-sensitive silver halide photographic material by means of an antistatic backing layer comprising a metal salt of a fatty acid (having from 8 to 18 carbon atoms) and a copolymer of styrene, vinyl acetate and a metal salt of acrylic acid (see U.S. Pat. No. 2,976,148); a method to impart a slipping property by applying a layer comprising pentaerythritol tetrastearate and tetraacetate to the top layer (see British Pat. No. 1,430,997); a method for lowering the friction of the back side surface of the light-sensitive photographic material by providing on the top layer of an antistatic or antihalation coating, a layer comprising a polyvinyl alcohol ester of a fatty acid having from 10 to 20 carbon atoms, a monostearate of glycerin, ethylene glycol diacetate, saccharose distearate and sorbitan monostearate (see West German Pat. No. 2,347,301); a method for improving the slipping property by incorporating a diester of hydroxyphthalic acid into at least one of the surface layers of the light-sensitive photographic material (see Japanese Laid-Open Patent Application No. 159221/1979); a method for improving the mechanical properties, especially the frictional coefficient, by using a phosphate and a transition metal oxide such as $GeO_3$, $V_2O_5$, $MoO_3$ or $WO_3$ as a substance for forming a glassy texture, for an antistatic composition layer and by incorporating into this layer, cellulose acetate and a lubricating agent such as carnauba wax as binding agents (see Japanese Laid-Open Patent Application No. 115291/1976); and a method for improving the slipping property by incorporating a liquid organopolysiloxane having a methyl group and an alkyl group having at least 5 carbon atoms as the organic group bonded to the silicone atom, into at least one of the light-sensitive photographic layers (see Japanese Laid-Open Patent Application No. 117414/1975).

However, if it is attempted to improve the slipping property or the like of the light-sensitive photographic material by means of these known methods, the effectiveness will be virtually lost by the developing treatment in many cases although the slipping property prior to the developing treatment will be improved.

If a greater amount is used to let the slipping property last after the developing treatment, it is likely that the transparency will be lost (if the surface of the light-sensitive photographic material is exposed under a high humidity condition, it is likely that the slipping compound (i.e., the compound which gives a slipping property) precipitates as a white powder over the surface of the light-sensitive material, namely a so-called "blooming" phenomenon occurs) and a coagulated substance will be formed in the coating solution, and thus it is likely that the coating property will be impaired and the slipping property will be degraded, whereby the surface of the light-sensitive layer becomes susceptible to scratching. To the contrary, if the sliding friction of the back surface of the light-sensitive material decreases too much, it will have at least one of the drawbacks such that, due to the extreme slipping property, the transportation efficiency in the drying step or the processing step tends to be rather degraded or when the light-sensitive photographic material is bonded, the bonding agent tends to be ineffective. Further, if the light-sensitive photographic material is stored under a high humidity condition for a long period of time, it frequently occurs that the front surface of the light-sensitive layer side and the back surface of the light-sensitive layer side stick together, and if the developing is carried out after peeling them off from each other, a photographic fog forms in the light-sensitive layer as the top layer or, in particular, at the peeled off portion or the non-developed portion. In a black and white light-sensitive material, the fog will be black. However, in a light-sensitive photographic material having a colour sensitivity to a coloured light, it undergoes colour development to have a yellow colour even without exposure if the top layer is an emulsion layer containing a layer which develops a yellow colour by a coupling reaction with the main developing reagent (one from the paraphenylenediamine series). This phenomenon has not yet been completely understood scientifically. However, it is considered that in certain cases, the yellow colour is developed by some electrical action due to discharge of the accumulated electrostatic charge generated at the time of peeling off the light-sensitive material which had been stuck together or due to the flow of the static electricity.

The following two methods have been proposed as measures to prevent the undesirable colour development phenomenon due to the fog formation or the sticking phenomenon. One of them is a method to reduce the adhesive property or stickiness of the surface of the light-sensitive material, thereby to eliminate the generation of electricity and to minimize the generation of static electricity, and the other method is to impart an antistatic property to the light-sensitive photographic material and thereby to reduce the electrostatic charge. As the former method, it is known to disperse a so-called matte agent such as silica or PMMA (polymethylmethacrylate) particles in the light-sensitive material and thereby to coarsen the surface, or to impart the slipping property as mentioned above. However, in spite of the reduction of the adhesiveness, no remarkable effectiveness for the prevention of the formation of the photographic fog has been obtained. If a greater amount is used to overcome this photographic fog by these methods, there will be various disadvantages such that the transparency is lost, coagulation occurs in the coating solution, the coating property is impaired, the slipping property is degraded, as whereby the surface tends to be susceptible to scratching, and to the contrary, the sliding friction of the back surface of the light-sensitive material decreases too much, whereby the transportation efficiency in the coating step, or the wrap processing step, is impaired. Further, some of the substances tend to reduce the sensitivity of the light-sensitive emulsion layer or to allow the formation of photographic fog thus degrading the photographic characteristics. Other than the above methods, there are a method for providing an organic fluoro compound on the back surface of the support (see Japanese Laid-Open Patent Application No. 99529/1975); a method for placing on the surface of the photographic emulsion layer a top layer comprising an acid-treated gelatin and an organic fluoro compound (see Japanese Laid-Open Patent Application No. 160034/1975); a method to incorporate a gelatin derivative and an anhydrous silicic acid colloid into the top layer of the light-sensitive material (see Japanese Laid-Open Patent Application No. 141320/1975); a method for incorporating an organic fluoro compound into the surface layer of the light-sensitive layer (see Japanese Laid-Open Patent Application No. 59025/1975); a method for coating hydrophilic colloidal layer containing an organic fluoro compound having a sulfonic acid group or a sulfonate group or a sulfuric acid ester group as the hydrophilic group as the top layer of the light-sensitive material (see Japanese Laid-Open Patent Application No. 43131/1976); a method for incorporating a compound represented by the formula

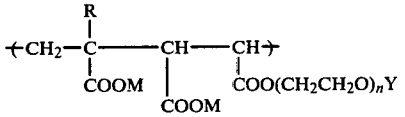

-continued

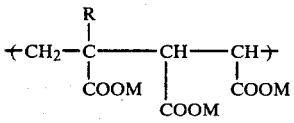

(where M is a hydrogen atom or an alkali metal atom,
Y is an organic residue having from 4 to 24 carbon atoms, and
R is a hydrogen atom or a methyl group)

into the surface layer of the light-sensitive material (see Japanese Laid-Open Patent Application No. 29923/1976); and a method for incorporating an alkyl polysiloxane having a polyoxyalkylene chain into at least one layer of the surface layers of the light-sensitive material (see Japanese Laid-Open Patent Application No. 16224/1977). However, even by these known methods, no substantial effectiveness is obtainable for eliminating the above-mentioned yellow photographic fog or the photographic fog formed at the peeled off portions or non-developed portions of the back surface of the base. Further, in U.S. Pat. No. 3,113,867, there is a disclosure of a technique wherein a high polymer similar to the high polymer of the present invention is used. However, when compared with the present invention, this technique gives an inferior slipping property and anti-scratching property after the developing treatment of the light-sensitive photographic material and inferior anomalous colour development, for the reason, for instance, such that the polymer used therein contains a less amount (from 5 to 8% by weight) of the repeating units represented by the under-mentioned general formula (I) of the present invention.

Further, as the method for imparting an antistatic property to the light-sensitive material, it is usual to take a measure to reduce the generation of electricity and charging by incorporating an antistatic agent. Such a measure is disclosed, for instance, in U.S. Pat. No. 3,625,696, No. 3,615,531, No. 3,564,043, No. 3,525,621, No. 3,457,076, No. 3,264,108 or No. 3,756,828.

However, most of the antistatic agents used therein, are hygroscopic and accordingly they rather tend to lead to the formation of the yellow photographic fog or the photographic fog at the peeled off portions or non-developed portions of the back surface of the base.

It is accordingly very difficult to expect a satisfactory effectiveness by merely imparting an antistatic property by means of the antistatic agent.

Accordingly, a first object of the present invention is to provide a light-sensitive photographic material having a surface layer which does not adhere even under a high temperature and high humidity conditions when the front surface layer of the light-sensitive material is brought in contact with the other surface and which is hardly subject to scratching.

A second object of the present invention is to provide a light-sensitive photographic material which is almost free from the formation of the photographic fog.

A third object of the present invention is to provide a light-sensitive photographic material which is free from the possibility of the peeling off of the back surface layer due to adhesion and from the formation of a defective developed portion on the photographic emulsion surface.

A fourth object of the present invention is to provide a light-sensitive material, in the case of a light-sensitive colour photographic material, in which the formation of the fog with abnormal yellow colour development in the photographic emulsion layer is prevented.

A fifth object of the present invention is to provide a light-sensitive photographic material which is hardly subject to scratching during various handling operations, for instance, in the production step, in the wrap processing step, at the time of shooting (in a camera), in the after-treatment steps such as developing, and at the time of projection.

A sixth object of the present invention is to provide a light-sensitive photographic material which is free from the formation of precipitates on the surface or in the inner portion, namely which is free from the "blooming" phenomenon.

The seventh object of the present invention is to provide a light-sensitive photographic material wherein a high polymer is used which does not give a photographically adverse effect to the light-sensitive layer by virtue of its non-diffusible character.

Other objects of the present invention will become apparent from the following description of the present specification. The above-mentioned various objects of the present invention are accomplished by a light-sensitive photographic material comprising a support and a light-sensitive layer formed thereon, which further comprises, in at least one of the front side (light-sensitive layer side) and the back side of the light-sensitive photographic material, at least one light-insensitive layer containing a high polymer having at least 20% by weight, preferably at least 50% by weight, of a repeating unit represented by the following general formula (I):

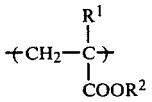

(I)

(where $R^1$ represents a hydrogen atom or a methyl group, and $R^2$ represents a straight chain alkyl group having from 8 to 24 carbon atoms, preferably from 12 to 24 carbon atoms).

The high polymer according to this invention may preferably be insoluble in water or a developing solution.

It is preferred that the co-polymer component for said high polymer, which gives a unit other than the repeating unit represented by the general formula (I), is a radical-polymerizable vinyl monomer. Further, said light-insensitive layer may preferably constitute a back side layer. Still further, said light-insensitive layer may also constitute a protecting layer for the light-sensitive layer side. Namely, the present invention is characterized in that, in a light-sensitive photographic material having at least one layer of a (silver halide) photographic emulsion layer on a support, at least one layer of the surface layers (i.e., the respective top layers at the photographic emulsion layer (light-sensitive layer) side of the support and at the back surface layer side of the support) of said light-sensitive material, contains a high polymer having the repeating unit represented by the above-mentioned general formula (I), and the top layer containing the high polymer may contain other high polymer binders.

The high polymers to be used by the present invention, are obtainable from individual monomers such as lauryl acrylate, lauryl methacrylate, dodecyl acrylate, tridecyl methacrylate, stearyl acrylate, and stearyl methacrylate, or by co-polymerizing these monomers with ethylenically unsaturated monomers co-polymerizable with the above-mentioned monomers. As such co-polymerizable monomers, there may be mentioned, for instance:

(1) olefins such as ethylene, and propylene,
(2) acrylic acid or methacrylic acid and esters thereof,
(3) acrylamides such as acrylamide, methacrylamide, and diacetone acrylamide,
(4) styrenes such as styrene, and α-methyl styrene, and
(5) acrylonitriles. However, they may be any ones which are copolymerizable with the above-mentioned acrylates or methacrylates of higher alcohols.

The polymers preferably used in the present invention will be exemplified below but it should be understood that the polymers useful for the present invention are not limited to those exemplified.

(1) 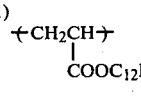 [Molecular weight (hereinafter referred to as Mw) = 500,000]

(2) 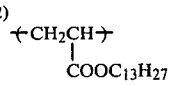 [Mw = 250,000]

(3) 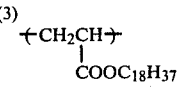 [Mw = 130,000]

(4) 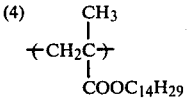 [Mw = 180,000]

(5) 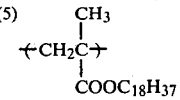 [Mw = 53,000]

(6) 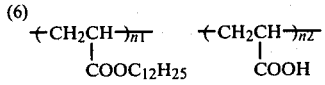 [n1:n2 = 80:20 Mw = 110,000]

(7) 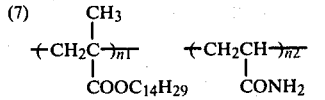 [n1:n2 = 90:10 Mw = 85,000]

(8) 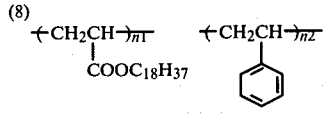 [n1:n2 = 90:10 Mw = 350,000]

(9) 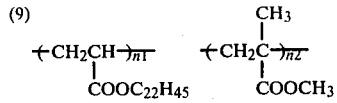 [n1:n2 = 70:30 Mw = 40,000]

(10) 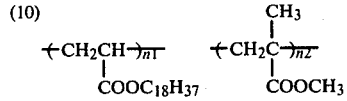 [n1:n2 = 80:20 Mw = 150,000]

-continued

(11) $\left(CH_2\overset{CH_3}{\underset{COOC_{18}H_{37}}{C}}\right)_{n1}\left(CH_2\underset{COOC_3H_7}{CH}\right)_{n2}$ [n1:n2 = 70:30, Mw = 72,000]

(12) $\left(CH_2\underset{COOC_{18}H_{37}}{CH}\right)_{n1}\left(CH_2CH_2\right)_{n2}$ [n1:n2 = 70:30, Mw = 83,000]

(13) $\left(CH_2\underset{COOC_{18}H_{37}}{CH}\right)_{n1}\left(CH_2\underset{CN}{CH}\right)_{n2}$ [n1:n2 = 90:10, Mw = 150,000]

(14) $\left(CH_2\underset{COOC_{18}H_{37}}{CH}\right)_{n1}\left(CH_2\overset{CH_3}{\underset{CN}{C}}\right)_{n2}$ [n1:n2 = 60:40, Mw = 100,000]

(15) $\left(CH_2\overset{CH_3}{\underset{COOC_{18}H_{37}}{C}}\right)_{n1}\left(CH_2\overset{CH_3}{\underset{COOCH_3}{C}}\right)_{n2}$ [n1:n2 = 90:10, Mw = 320,000]

(16) $\left(CH_2\underset{COOC_{16}H_{33}}{CH}\right)_{n1}\left(CH_2\underset{COOH}{CH}\right)_{n2}$ [n1:n2 = 80:20, Mw = 83,000]

(17) $\left(CH_2\underset{COOC_{18}H_{37}}{CH}\right)_{n1}\left(CH_2\overset{CH_3}{\underset{COOH}{C}}\right)_{n2}$ [n1:n2 = 90:10, Mw = 120,000]

(18) $\left(CH_2\underset{COOC_{18}H_{37}}{CH}\right)_{n1}\left(CH_2\underset{COONH_2}{CH}\right)_{n2}$ [n1:n2 = 80:20, Mw = 53,000]

(19) $\left(CH_2\underset{COOC_{18}H_{37}}{CH}\right)_{n1}\left(CH_2\underset{CONHCH_2OH}{CH}\right)_{n2}$ [n1:n2 = 95:5, Mw = 100,000]

The above-mentioned high polymers are obtainable by ordinary radical polymerization. The manner of the polymerization may be chosen from solution polymerization, emulsion polymerization, bulk polymerization, suspension polymerization, etc., depending upon the particular purposes and natures.

It is preferred that the polymer according to the present invention is contained in the light-insensitive layer in an amount of not less than 15% by weight.

Now, Examples of the synthesis will be described below. However, the present invention is not limited to these Examples.

SYNTHESIS EXAMPLE 1 (Example for the synthesis of the exemplified polymer (3))

In a pressure bottle, 100 g. of stearyl acrylate was dissolved in 300 ml. of benzene, and 0.5 g. of azobisisobutyronitrile was added thereto and dissolved. The solution was left at 60° C. in a constant temperature bath for 24 hours, cooled to room temperature, and dropwisely added to 3 l. of methanol, whereby 98 g. of the desired substance was obtained. The substance had a melting point of 48° C. and a molecular weight of 130,000 as measured by an osmotic method.

SYNTHESIS EXAMPLE 2 (Example for the synthesis of the exemplified polymer (8))

A stirring rod, a thermometer, a nitrogen supply tube, and a cooling tube, were attached to a one liter flask with four heads. Into the flask, 600 ml. of water, 1 g. of sodium dodecylbenzene sulfonate, 180 g. of stearyl acrylate, and 20 g. of styrene were introduced, stirred, emulsified, and then heated to a temperature of 60° C. while supplying nitrogen gas. Added thereto was 0.1 g. of ammonium persulfate, and the mixture was kept at 60° C. for 4 hours. Then, the mixture was cooled to room temperature, and 5 l. of a saturated sodium chloride aqueous solution was added to precipitate the polymer, which was then separated by filtration to obtain 198 g. of the desired substance. The substance had a melting point of 45° C. and a molecular weight of 350,000 as measured by an osmotic method.

SYNTHESIS EXAMPLE 3 (Example for the synthesis of the exemplified polymer (10))

A stirring rod, a thermometer, a nitrogen supply tube and a cooling tube were attached to a one liter flask with four heads. Into the flask, 600 ml. of water, 160 g. of stearyl acrylate, 40 g. of methylmethacrylate, 3 g. of benzoyl peroxide and 4 g. of calcium phosphate were introduced, kept at 80° C. for 4 hours while supplying nitrogen, and then cooled. After a treatment with hydrochloric acid, filtration and drying were carried out, whereby 198 g. of the desired substance was obtained. The substance had a melting point of 45° C. and a molecular weight of 110,000 as measured by an osmotic method.

The high polymers to be used in the present invention have a molecular weight of from 10,000 to 5,000,000, preferably from 50,000 to 1,000,000.

As a solvent for these high polymers to be used in the present invention, there may be used, for instance, acetone, ethyl acetate, methylenedichloride, ethylenedichloride, trichlene, benzene, cyclohexane, trichloroethane, trichloromethane, xylene, toluene, carbon tetrachloride, phenol or resorcinol. These solvents may be used alone or in combination as the case requires.

Further, the amount of the high polymer to be used in the present invention is preferably from about 0.01 to about 3 g., more preferably from 0.05 to 1 g., per 100 ml. of said solvent. In a case where it is coated on a support, it is preferably used in an amount of from 5 to 100 mg. per 1 $m^2$ of the support.

The high polymers to be used in the present invention may be used singly or as a combination of two or more kinds.

When the light-insensitive layer containing the high polymer used in the present invention constitutes a coating on the back side, the coating on the back side may be in a form of a single layer or a plurality of layers. If the coating on the back side comprises a plurality of layers, the high polymer of the present invention is incorporated in the top layer on the back side, or may be incorporated in different layers on the back side at the same time. And, it is desirable that an antistatic agent and a hydrophobic polymer are incorporated in the layers on the back side which contain the high polymer of the present invention.

According to a preferred embodiment of the present invention, at least one light-sensitive silver halide emulsion layer is provided on one side of the support, and on the other side (i.e., the back side) of the support, there are provided (i) at least one layer containing a hydrophobic polymer and (ii) at least one layer containing the high polymer of the present invention, said layer (i) being located nearer to the support than said layer (ii).

According to another preferred embodiment of the present invention, on the back side of the support, there are provided (i) at least one layer containing the high polymer of the present invention and a hydrophobic polymer and (ii) at least one layer containing an antistatic agent, said layer (ii) being located nearer to the support than said layer (i).

According to still another preferred embodiment of the present invention, on the back side of the support, there are provided (i) at least one layer containing the high polymer of the present invention and a hydrophobic polymer, and (ii) at least one layer containing an antistatic agent and a hydrophobic polymer, said layer (ii) being located nearer to the support than said layer (i).

Further, according to another preferred embodiment of the present invention, on the back side of the support, there are provided (i) at least one layer containing the high polymer of the present invention and (ii) at least one layer containing an antistatic agent and a hydrophobic polymer, said layer (ii) being located nearer to the support than said layer (i).

In each of the above-mentioned preferred embodiments of the present invention, the light-insensitive layer containing the high polymer of the present invention is provided on the back side of the support. However, each of these preferred embodiments is applicable to a case where the light-insensitive layer containing the high polymer of the present invention is provided on the front side of the support, i.e. on the surface of the light-sensitive layer side, as a protecting layer, and in this case, the term "on the back side of the support" should be read as "on the front side of the support".

The antistatic agent to be used in the present invention is the one which gives good conductivity and which presents, by itself or together with a proper binder, a good film forming property. As such an antistatic agent, there may be mentioned, for instance, a co-polymer salt of ethylene and ethylene undecanoic acid disclosed in U.S. Pat. No. 3,033,679; maleic acid or a maleinimide resin as disclosed in U.S. Pat. No. 2,279,410; an alkali metal salt of an alkylallyl polyether sulfonic acid and an alkali metal salt of a carboxylic acid polymer as disclosed in U.S. Pat. No. 3,525,621; an alkali metal salt of a polycarboxylic acid as disclosed in U.S. Pat. No. 3,630,742; polyethylene sulfonic acid as disclosed in U.S. Pat. No. 2,735,841; a quaternary salt of polyvinyl pyridine as disclosed in U.S. Pat. No. 3,072,484; quaternary polyethyleneimine as disclosed in U.S. Pat. No. 3,479,215; polyepichlorohydrin as disclosed in U.S. Pat. No. 3,320,317; or a polyquaternary alkylaminoacrylate as disclosed in U.S. Pat. No. 2,882,157, and other than the above, there may further be mentioned various antistatic agents disclosed in Japanese Laid-Open Patent Applications No. 24159/1971, No. 54672/1975, and No. 94053/1975, and Japanese Patent Application No. 45458/1976.

Further, it is desirable to use as the antistatic agent for the present invention other than the above-mentioned high polymer electrolytes, an inorganic oxide containing an electrolyte, particularly alumina sol, and to apply it as a back layer coating.

Generally, as most of the antistatic agents comprising a high polymer electrolyte are hydrophilic, they are likely to bring about various drawbacks especially when applied to a light-sensitive silver halide photographic material, for instance, such as an adhesion defect where the light-sensitive silver halide photographic material sticks to itself during the above mentioned high temperature operation, or the formation of turbidity or sludge as a result of elution of the antistatic coating into a treating solution during the developing treatment and the combination thereof with other substances in the treating solution whereby the antistatic property is lost during the developing treatment. Such undesirable phenomena may be prevented by providing a layer coated with alumina sol containing an electrolyte as the layer of the coating on the back side. (hereinafter referred to as "first back side layer"), located near the support, and further providing a layer containing a hydrophobic polymer as the second back side layer (a layer on the back side located far from the support-the same term is used hereinafter in the same meaning) on said first back side layer.

It is possible to improve the physical properties such as the scratch resistance and slipping property during the process for the production of the light-sensitive photographic material or against a camera or printer, by incorporating the high polymer according to the present invention together with the hydrophobic polymer of said second back side layer.

Further, the high polymers according to the present invention are very effective for the prevention of abnormal colour development or failures of a light-sensitive material for colour photography without giving photographically adverse effects (i.e., the formation of photographic fog and reduction of the sensitivity) to the light-sensitive photographic material. This effectiveness brings about a great advantage in that the range of conditions for storage and use of unexposed and/or undeveloped light-sensitive photographic materials is widened. Especially in the case of a light-sensitive material for colour photography, coating is repeated many times and it is usually rolled in a substantial length, and accordingly it is likely that an abnormal colour development occurs. It is possible to prevent this completely by applying the high polymer according to the present invention.

Further, the high polymers according to the present invention does not at all give rise to the blooming phenomenon which usually happens when low polymers known as slipping agents for photography, are kept under high humidity.

The hydrophobic polymer to be used for the present invention may be any polymer which is soluble or dispersible as a coating solution and which is capable of forming a thin layer after the coating solution is applied and dried, said thin layer being insoluble in an acid or alkali aqueous solution. As specific examples of such a hydrophobic polymer, there may be mentioned polymers or co-polymers such as polymethylmethacrylate, polyethylene, polyvinylidene chloride, polyacrylonitrile and vinylacetate; cellulose derivatives such as cellulose diacetate, cellulose triacetate, cellulose nitrate, ethyl cellulose, and cellulose propionate; and further acetals such as polyvinyl formal, polyvinyl acetal, and polyvinyl benzal; vinyl chloride/vinylidene chloride co-polymer; vinyl chloride/acrylonitrile co-polymer; and an ester of acrylic acid/vinyl chloride/vinyl acetate co-polymer. Further, according to the present invention, a latex of these hydrophobic polymers may also be used. It is especially desirable to use material which relatively hardly generates static electricity, such as cellulose diacetate, polyethylene or polyvinyl acetal. These hydrophobic polymers may be used singly or as a mixture with other materials as the case requires. For instance, matte agents, plasticizers, defoaming agents or other assisting agents may be used together. As preferred matt agents, there may be mentioned oxides such as silicon oxide, aluminum oxide, magnesium oxide, etc. having a particle diameter of from 0.01 to 0.5 micron. By the addition of these agents, it is possible to remarkably reduce the charging of various kinds, of rollers, particularly rubber rollers, used during the process for the production of light-sensitive photographic materials or in the equipments of cameras and automatic developers.

Now, a detailed description will be given with respect to the method for the formation of the light-insensitive layer at the top surface of the light-sensitive photographic material according to the invention, particularly with respect to the method for the formation of the back side layer. However, the construction of the back side layer is not limited to this, and a description will be given with respect to preferred embodiments of the back side layer according to the present invention.

For instance when an antistatic agent is applied as the first back side layer on the back side, firstly it is dissolved or dispersed in a proper solvent, and then, this solution or dispersion is coated on the support and dried. As the solvent for the antistatic agent, there may be mentioned methanol, ethanol, acetone, etc. which may be used as a mixture of more than one kinds.

This solution is applied onto the support by an optional method such as dip coating, roller coating or spray coating, to form a layer. The drying operation of the applied layer may be carried out according to a usual method. There is no particular limitation for the concentration of the antistatic agent in the coating solution. However, an amount from 0.01 to 10 g. per 100 ml. of the solvent is advantageous for the convenience of coating and drying. In a usual case for its use, it is possible to impart an adequate antistatic effectiveness by an application of the antistatic agent in an amount of from 3 to 300 mg/m$^2$. Further, in a case where an inorganic oxide containing an electrolyte, particularly alumina sol, is used as the antistatic agent, the concentration of said alumina dispersion solution is within a range of from about 0.1 to 1% by weight is preferred from the standpoints of processability and conductivity. In this case, the dispersion medium preferably contains a substance having a property to dissolve or swell the surface of the support to a certain degree. Specifically, there may be used acetone, methanol, ethanol, dimethylformamide, dimethylacetamide, methyl cellosolve, ethyl cellosolve, methyl ethyl ketone, methyl isobutyl ketone and benzoyl may be used in a proper combination. In case the support is made of polyethylene terephthalate, there may be used, in addition to the above mentioned solvents, a suitable solvent selected from phenyl, methylene chloride, ethylene chloride, dioxane, resolcinol, catechlol, and the like. With these solvents, coating compositions are prepared and applied in such an amount that the amount of aluminum oxide in the aluminum sol becomes to be from 5 to 500 mg. as solid, per 1 m$^2$ of the support.

Further, in a case where a hydrophobic polymer is incorporated in the first back side layer, there may be added to the alumina sol or the high polymer electrolyte, one or more kinds of the above mentioned hydrophobic polymers, particularly cellulose diacetate, cellulose nitrate, ethyl cellulose, cellulose butylate and a three component co-polymer of vinylidene/methyl acrylate/acrylate. In this case, the amount of the hydrophobic polymer is preferably within a range of from 0.05 to 5 g. per 1 g. said antistatic agent.

Further, in case the support is made of polyethylene terephthalate, it is preferable to firstly provide an under-layer without directly applying the first back side layer of the present invention, and then provide the first back side layer of the present invention on the under-layer. For the under-layer, there may be used, singly or as a combination of two or more kinds, polyvinylidene chloride, polyvinylidene chloride/acrylonitrile co-polymer, vinyl chloride/vinylidene chloride co-polymer, vinyl chloride/vinylidene chloride co-polymer, vinyl chloride/vinylacetate co-polymer, vinyl chloride/methacrylate co-polymer, polyglycidyl methacrylate, cellulose diacetate, cellulose triacetate, ethyl cellulose and low polymerization polyester or its modification with other substance, and they may be dissolved in a solvent, applied to the support and dried by known methods.

Further, as the support of the light-sensitive photographic material according to the present invention, there may be used a hydrophobic film or sheet such as polycarbonate, polystyrene, polyolefin, or polyethylene laminated paper, in addition to the above-mentioned cellulose triacetate and polyethylene terephthalate.

In the present invention, the second back side layer may be provided directly or via an intermediate layer, on the first back side layer so that the above-mentioned high polymer of the present invention becomes in the above-mentioned amount. In this case, in order to incorporate the hydrophobic polymer in the second back side layer, there may be used as the solvent, the same solvent as used for the coating composition containing the high polymer of the present invention. A coating composition may be prepared by dissolving said hydrophobic polymer in an amount of from 0.1 to 1% by weight, and it may be applied on the dried first back side layer and dried. The method for application may be a usual method such as dip coating, roller coating or spray coating as for the case of the first back side layer. Further, the applied layer may be dried according to a usual method.

By providing according to a usual method of light-sensitive silver halide layer on the opposite surface (i.e., the surface on the opposite side) to the surface on which the back side layer is provided, a light-sensitive photographic material according to the present invention is obtainable and the above-mentioned objects of the present invention can be accomplished. Particularly, said light-sensitive photographic material has improved physical properties such as scratch resistance and slipping property, and it is capable of providing a remarkable effectiveness for the prevention of the failures of abnormal colour development of light-sensitive material for colour photography and is free from the degradation of other properties (for instance, a reduction of sensitivity, an increase of fogging or a fluctuation of gamma).

Now, the invention will be described in further detail with reference to Examples. However, the present invention is not limited to these Examples.

EXAMPLE 1

On one side of a biaxially stretched, crystallized polyethylene terephthalate film having a thickness of 100 microns, a solution having the following composition was applied in an amount of 20 ml/m$^2$, and dried at 120° C. for 10 minutes.

| | |
|---|---|
| Cellulose triacetate | 0.3 g. |
| Co-polymer comprising vinylidene chloride, methyl acrylate and acrylic acid (65:35:2 in weight ratio) | 0.1 g. |
| Methylene chloride | 20 ml. |
| Ethylene chloride | 65 ml. |
| Resorcinol | 15 ml. |

Then, a solution having a composition as shown in Table 1 was applied on this layer in an amount of 25 ml/m$^2$, and dried at 90° C. for 3 hours to form a back side layer.

TABLE 1

| | Coating solutions for the back side layers | | | |
|---|---|---|---|---|
| Back side layer Nos. | 1-1 | 1-2 | 1-3 | Nil |
| Co-polymer of stearyl acrylate and styrene (Polymerization ratio: 70:30) (Molecular weight: 130,000) | 0.05 g. | 0.10 g. | 0.15 g. | 0 |
| Acetone | 30 ml. | 30 ml. | 30 ml. | 0 |
| Ethyl acetate | 50 ml. | 50 ml. | 50 ml. | 0 |
| Toluene | 20 ml. | 20 ml. | 20 ml. | 0 |
| Obtained base Nos. | [1-1] | [1-2] | [1-3] | [1-4] |

On the opposite side of the back side layer of each of the above four bases [1-1], [1-2], [1-3] and [1-4], an under-layer was provided, and thereon, a red sensitive emulsion layer, an intermediate gelatin layer, a green sensitive emulsion layer, a yellow filter layer, a blue sensitive emulsion layer and a protecting layer were provided in this order, whereby samples (1-1), (1-2), (1-3) and (1-4) of the corresponding photographic colour negative films were obtained.

These samples were subjected to an evaluation of the slipping property and the scratch resistance of the back side surface and a test for abnormal yellow colour development failure at a temperature of 23° C. and in an atmosphere of 55% RH. Items for the test were (1) kinetic friction coefficient (against a steel ball), (2) scratch resistance and (3) a test for abnormal yellow colour development failure.

(1) Method for measuring kinetic friction coefficients (An apparatus for measuring kinetic friction coefficients, made by Toyo Boldwin Co., was used).

A steel ball of 5 m/mϕ with a load of 20 g. was brought into contact with the back side surface of the sample. The resistance values when it was allowed to slide for 8 cm. at a speed of 20 cm/min. were detected by a strain gauge and automatically recorded on a chart.

(2) Method for measuring scratch resistance

For the evaluation of scratch resistance, a static load was exerted on a sapphire needle having a radius of curvature of 0.15 mm., the needle was moved at a constant speed (6.0 cm/sec.) on the sample, and the load at the time of the formation of a scratch was determined. And the load thus obtained was used.

(3) Method for measuring in a test for abnormal yellow colour development failure The sample was cut into a size of 4 cm$^2$., and subjected to controlled humidity at a temperature of 23° C. under 80% RH for two days. Then, one was placed over another so as to bring the emulsion surface into contact with the back side surface, and a load of 20 g/cm. was exerted for 2 days. Further, they were then subjected to a heat treatment at 50° C. They were peeled and subjected to a usual treatment for colour film development without exposure. The area (%) of the abnormal yellow colour development was evaluated.

The results thereby obtained are shown in Table 2.

TABLE 2

| | Slipping property Kinetic friction coefficients | | Scratch resistance [g] | | Abnormal yellow colour |
|---|---|---|---|---|---|
| Sample Nos. | Before development | After development | Before development | After development | development area [%] |
| (1-1) | 0.29 | 0.30 | 120 | 130 | 10 |
| (1-2) | 0.27 | 0.28 | 150 | 150 | 0 |
| (1-3) | 0.25 | 0.24 | 160 | 150 | 0 |
| (1-4) | 0.45 | 0.47 | 10 | 10 | 80 |

It is apparent from the results shown in Table 2 that each of the films (1-1), (1-2) and (1-3) of the present invention having the high polymers of the present invention applied thereon, has an improved scratch resistance and a minimal abnormal yellow colour development area, as compared with the comparative film (1-4) having no high polymer applied thereon.

EXAMPLE 2

On one side of a cellulose triacetate film having a thickness of 120 microns, a solution having the following composition was applied in an amount of 20 ml/m$^2$ and dried at 90° C. for 3 minutes.

| | |
|---|---|
| Cellulose diacetate | 1 g. |
| Acetone | 70 ml. |
| Methanol | 30 ml. |

A solution as shown in the following Table 3 and comprising a co-polymer (molecular weight: 100,000 to 150,000) comprising stearyl methacrylate and methyl methacrylate in a different ratio, was applied thereon in an amount of 20 ml/m$^2$ and dried at 90° C. for 3 minutes.

TABLE 3

| | Coating solution for the back side layer | | | |
|---|---|---|---|---|
| Back side layer Nos. | 2-1 | 2-2 | 2-3 | Nil |
| Polymerization ratio of stearyl methacrylate and methyl methacrylate 90:10 | 0.1 g. | — | — | — |
| Polymerization ratio of the same: 70:30 | — | 0.1 g. | — | — |
| Polymerization ratio of the same: 40:60 | — | — | 0.1 g. | — |
| Acetone | 20 ml. | 20 ml. | 20 ml. | — |
| Ethyl acetate | 60 ml. | 60 ml. | 60 ml. | — |
| Toluene | 20 ml. | 20 ml. | 20 ml. | — |
| Obtained base Nos. | [2-1] | [2-2] | [2-3] | [2-4] |

On the opposite side of each of the above four bases [2-1], [2-2], [2-3] and [2-4], a colour negative emulsion agent for high sensitivity photography similar to Example 1 was applied, whereby samples (2-1), (2-2), (2-3) and (2-4) of the corresponding photographic colour negative films were obtained. In a manner similar to Example 1, tests for slipping property, scratch resistance and abnormal yellow colour development failure were carried out, and the results as shown in the following Table 4 were obtained.

TABLE 4

| Sample Nos. | Slipping property Kinetic friction coefficients: Before development | After development | Scratch resistance [g]: Before development | After development | Abnormal yellow colour development area [%] |
|---|---|---|---|---|---|
| (2-1) | 0.23 | 0.24 | 160 | 180 | 0 |
| (2-2) | 0.25 | 0.25 | 170 | 190 | 0 |
| (2-3) | 0.22 | 0.23 | 160 | 180 | 0 |
| (2-4) | 0.46 | 0.48 | 20 | 20 | 80 |

It is apparent from the results shown in Table 4 that each of the sample (2-1), (2-2) and (2-3) having, applied thereon, the co-polymers of stearyl methacrylate and methyl methacrylate as the high polymers of the present invention, has a superior scratch resistance before or after development and is free from the formation of abnormal yellow colour development.

EXAMPLE 3

On a cellulose triacetate film having a thickness of 120 microns, each of the following antistatic agents [A], [B] and [C] was applied in an amount of 25 ml/m$^2$ as the first back side layer, and dried at 90° C. for 3 minutes, whereby bases [3-1], [3-2] and [3-3] as shown in the following Table 5 were prepared.

TABLE 5

| First back side layer Nos. | Coating solutions for the first back side layer: 3-1 | 3-2 | 3-3 |
|---|---|---|---|
| Acetone | 40 ml. | 40 ml. | 40 ml. |
| Methanol | 60 ml. | 60 ml. | 60 ml. |
| Antistatic agent [A] | 0.3 g. | — | — |
| Antistatic agent [B] | — | 0.3 g. | — |
| Antistatic agent [C] | — | — | 0.3 g. |
| Obtained base Nos. | [3-1] | [3-2] | [3-3] |

Antistatic agent

[A]

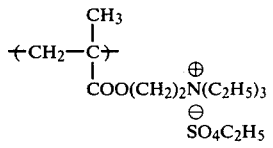

[B]

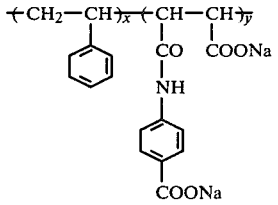

[x:y = 50:50]

[C]

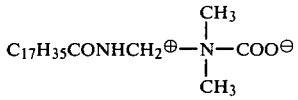

On each of these bases [3-1], [3-2], and [3-3], the following solution for the second back side layer was over-coated in an amount of 20 ml/m$^2$, and dried at 90° C. for 3 minutes.

| | |
|---|---|
| Acetone | 20 ml. |
| Ethyl acetate | 60 ml. |
| Toluene | 20 ml. |
| Cellulose diacetate | 0.4 g. |
| 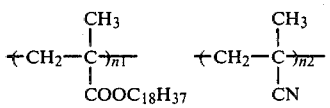 | 0.1 g. |
| [n1:n2 = 60:40, Molecular weight: 110,000] | |
| Fine silica particles (particle size: at most 1 micron) | 0.05 g. |

On the opposite side of each base thus obtained, a colour negative emulsion for high sensitivity photography similar to Example 1 was applied, whereby samples (3-1), (3-2), and (3-3) of photographic colour negative films were obtained. In the same manner as in Example 1, tests for slipping property, scratch resistance and abnormal yellow colour development were carried out, and the results as shown in the following Table 6 were obtained.

TABLE 6

| Sample Nos. | Slipping property Kinetic friction coefficients: Before development | After development | Scratch resistance [g]: Before development | After development | Abnormal yellow colour development area [%] |
|---|---|---|---|---|---|
| (3-1) | 0.23 | 0.22 | 170 | 160 | 0 |
| (3-2) | 0.24 | 0.23 | 160 | 170 | 0 |
| (3-3) | 0.22 | 0.21 | 180 | 170 | 0 |

It is apparent from Table 6 that each of the samples according to the present invention has a superior scratch resistance before and after development and is free from the formation of abnormal yellow colour development.

EXAMPLE 4

On a cellulose triacetate film having a thickness of 120 microns, the following solution for the first back side layer was applied in an amount of 25 ml/m$^2$, and dried at 90° C. for 3 minutes.

| | |
|---|---|
| Alumina sol (made by Nissan Chemical Industries, Ltd.) | 2 g. |
| Cellulose diacetate | 0.5 g. |
| Acetone | 50 ml. |
| Methanol | 50 ml. |

Further thereon, a coating solution for the second back side layer as shown in the following Table 7, was over-coated in an amount of 20 ml/m$^2$, and dried at 90° C. for 3 minutes, thereby forming the second back side layer.

TABLE 7

| Second back side layer Nos. | Coating solutions for the second back side layer: 4-1 | 4-2 | Nil |
|---|---|---|---|
| Co-polymer of stearyl acrylate and methyl methacrylate (Polymerization ratio being 5:5) (Molecular weight: 120,000) | 0.2 g. | — | — |

TABLE 7-continued

| Second back side layer Nos. | Coating solutions for the second back side layer 4-1 | 4-2 | Nil |
|---|---|---|---|
| Comparative compound [A] as shown below | — | 0.2 g. | — |
| Acetone | 30 ml. | 40 ml. | — |
| Methanol | — | 60 ml. | — |
| Ethyl acetate | 60 ml. | — | — |
| Toluene | 10 ml | | |
| Obtained base Nos. | [4-1] | [4-2] | [4-3] |

Comparative compound [A]

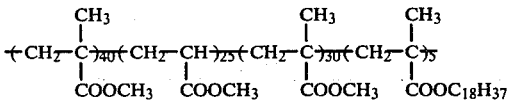

On the opposite side of each of the above bases [4-1], [4-2] and [4-3], a colour negative emulsion for high sensitivity photography similar to Example 1 was applied, whereby samples (4-1), (4-2) and (4-3) of the corresponding photographic colour negative films were obtained.

In the same manner as in Example 1, tests for slipping property, scratch resistance and abnormal yellow colour development were carried out, and the results as shown in Table 8 were obtained.

TABLE 8

| Sample Nos. | Slipping property Kinetic friction coefficients Before development | After development | Scratch resistance [g] Before development | After development | Abnormal yellow colour development area [%] |
|---|---|---|---|---|---|
| (4-1) | 0.25 | 0.24 | 170 | 160 | 0 |
| (4-2) | 0.39 | 0.47 | 70 | 20 | 70 |
| (4-3) | 0.45 | 0.46 | 20 | 20 | 80 |

It is apparent from the results shown in Table 8 that by the addition of the high polymers of the present invention, the scratch resistance can be remarkably improved before and after the development, and no abnormal yellow colour development is observed.

On the other hand, in the case where the comparative compound is used, some effectiveness is noticiciable before the development. However, no effectiveness is observed after the development treatment, and abnormal yellow colour development is distinctly observed.

EXAMPLE 5

On a cellulose triacetate film having a thickness of 120 microns, the coating solution for the first back side layer, as shown in Example 4, was applied to an amount of 20 ml/m$^2$, and dried at 90° C. for 3 minutes. Further, on this base, a coating solution for the second back side layer as shown in the following Table 9 was overcoated in an amount of 25 ml/m$^2$, and dried at 90° C. for 3 minutes, thereby forming the second back side layer.

TABLE 9

| Second back side layer Nos. | Coating solutions for the second back side layer 5-1 | 5-2 | 5-3 | 5-4 | 5-5 |
|---|---|---|---|---|---|
| Cellulose diacetate | 0.2 g. | 0.2 g. | 0.2 g. | 0.2 g. | 0.2 g. |
| Acetone | 30 ml. | 30 ml. | 30 ml. | 30 ml. | 30 ml. |
| Ethyl acetate | 50 ml. | 50 ml. | 50 ml. | 50 ml. | 50 ml. |
| Benzene | 20 ml. | 20 ml. | 20 ml. | 20 ml. | 20 ml. |
| Compound of the present invention as shown in Table 7 | 0.1 g. | | | | |
| Comparative compound [B] | | 0.3 g. | | | |
| Comparative compound [C] | | | 0.3 g. | | |
| Comparative compound [D] | | | | 0.3 g. | |
| Fine silica particles (particle size: at most 1 micron) | 0.04 g. | 0.04 g. | 0.04 g. | 0.04 g. | 0.04 g. |
| Obtained base Nos. | [5-1] | [5-2] | [5-3] | [5-4] | [5-5] |

Comparative compound [B]

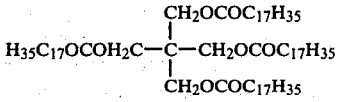

Comparative compound [C]

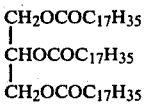

Comparative compound [D] $C_{17}H_{35}COONH_2$

On the opposite side of each of the obtained bases [5-1], [5-2], [5-3], [5-4] and [5-5], a colour negatives emulsion similar to Example 1 was applied, whereby samples (5-1), (5-2), (5-3), (5-4) and (5-5) of the corresponding negative films were obtained.

In the same manner as in Example 1, each sample was tested for slipping property, scratch resistance and abnormal yellow colour development. Further, with respect to each sample, the degree of blooming was investigated by leaving it under high humidity in accordance with the following manner. The results thereby obtained are shown in Table 10.

[BLOOMING TEST]

(1) The sample was kept in a container maintained at 23° C. under 90% RH for [A] 14 days and [B] one month, and the surface of the back side layer was observed by naked eyes under white light.

(2) Each sample was placed in a patrone and left to stand at 40° C. under 80% RH for 14 days and the surface of the back side layer was observed by naked eyes under white light.

TABLE 10

| Sample Nos. | Slipping property Kinetic friction coefficients: Before development | After development | Scratch resistance [g]: Before development | After development | Abnormal yellow colour development area [%] | Blooming test (1)-[A] | (1)-[B] | (2) |
|---|---|---|---|---|---|---|---|---|
| (5-1) | 0.22 | 0.23 | 190 | 180 | 0 | O | O | O |
| (5-2) | 0.29 | 0.31 | 160 | 150 | 80 | X | XX | XX |
| (5-3) | 0.37 | 0.38 | 120 | 130 | 80 | X | XX | XX |
| (5-4) | 0.40 | 0.42 | 130 | 120 | 50 | X | XX | XX |
| (5-5) | 0.47 | 0.48 | 10 | 10 | 80 | O | O | O |

In the above Table,
"O" means no change,
"X" precipitation of white powder on the surface, and
"XX" precipitation of a great amount of white powder on the surface.

It is apparent from Table 10, that the sample (5-1) having the high polymer of the present invention incorporated therein, has a superior scratch resistance, and it is free from abnormal yellow colour development and blooming.

On the other hand, the samples (5-2), (5-3) and (5-4) having the comparative compounds [B], [C] and [D] incorporated therein, show some effectiveness for scratch resistance, but they have great abnormal yellow colour development areas and, when they were left under high humidity, blooming phenomena wherein the compounds precipitated on the surface, were observed. Thus, it is found that they give an adverse effect to the transparency of the films.

EXAMPLE 6

On a cellulose triacetate film having a thickness of 120 microns, a coating solution for the first back side layer as shown in Example 4 was applied in an amount of 20 ml/m$^2$, and dried at 90° C. for 3 minutes.

Further thereon, a coating solution for the second back side layer as shown in the following Table 11 was over-coated in an amount of 20 ml/m$^2$, and dried at 90° C. for 3 minutes, whereby bases [6-1], [6-2] and [6-3] were prepared.

TABLE 11

| Second back side layer Nos. | Coating solutions for the second back side layer: 6-1 | 6-2 | 6-3 |
|---|---|---|---|
| Polystyrene | 0.3 g. | 0.3 g. | 0.3 g. |
| Compound of the present invention as shown in Table 7 | — | 0.1 g. | 0.1 g. |
| Fine silica particles (average particle size: at most 1 micron) | 0.02 g. | — | 0.02 g. |
| Acetone | 30 ml. | 30 ml. | 30 ml. |
| Ethyl acetate | 50 ml. | 50 ml. | 50 ml. |
| Cyclohexane | 20 ml. | 20 ml. | 20 ml. |
| Obtained base Nos. | [6-1] | [6-2] | [6-3] |

On the opposite side of each of the obtained bases [6-1], [6-2] and [6-3], a colour negative emulsion for high sensitivity photography similar to Example 1 was applied, samples (6-1), (6-2) and (6-3) of the corresponding colour negative films were obtained. In the same manner as in Example 1, tests for slipping property and scratch resistance were carried out. The results thereby obtained are shown in the following Table 12.

TABLE 12

| Sample Nos. | Slipping property Kinetic friction coefficients: Before development treatment | After development treatment | Scratch resistance [g]: Before development treatment | After development treatment |
|---|---|---|---|---|
| (6-1) | 0.45 | 0.47 | 10 | 10 |
| (6-2) | 0.24 | 0.25 | 120 | 110 |
| (6-3) | 0.25 | 0.26 | 190 | 200 |

It is apparent from the results shown in Table 12 that the comparative sample (6-1) having only polystyrene incorporated therein has a substantially inferior scratch resistance. Whereas, the sample (6-2) and (6-3) according to the present invention and having the high polymers of the present invention incorporated therein, have a remarkably improved scratch resistance.

We claim:

1. A multi-layer light-sensitive silver halide photographic material comprising a support and a light-sensitive silver halide emulsion layer, said support having a front side and a back side, which further comprises, in at least one of the front and back sides thereof, at least one light-insensitive layer containing a high polymer having at least 20% by weight of a repeating unit represented by the formula (I):

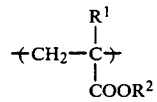

(I)

wherein $R^1$ represents a hydrogen atom or a methyl group, and $R^2$ represents a straight chain alkyl group having 12 to 24 carbon atoms.

2. The light-sensitive silver halide photographic material as claimed in claim 1, wherein said light-insensitive layer is located in the back side of the light-sensitive material.

3. The light-sensitive silver halide photographic material as claimed in claim 2, wherein said light-insensitive layer is located in said back side which comprises a plurality of layers and said light-insensitive layer is the outermost layer thereof.

4. The light-sensitive silver halide photographic material as claimed in claim 1 or 3, wherein said light-insensitive layer constitutes a protecting layer for the light-sensitive silver halide emulsion layer.

5. The light-sensitive silver halide photographic material as claimed in claim 1 or 3, wherein said high polymer is insoluble in water or a developing solution.

6. The light-sensitive silver halide photographic material as claimed in claim 1 or 3, wherein said high polymer comprises at least 50% by weight of the repeating unit.

7. The light-sensitive silver halide photographic material as claimed in claim 1 or 3, wherein the copolymer component for said high polymer giving a unit other than the repeating unit represented by formula (I) is a radical-polymerizable vinyl monomer.

8. The light-sensitive silver halide photographic material as claimed in claim 1 or 3, wherein $R^2$ represents a dodecyl group, a tridecyl group or an octadecyl group.

9. The light-sensitive silver halide photographic material as claimed in claim 8, wherein said high polymer is polymerized from at least one monomer selected from the group consisting of lauryl acrylate, lauryl methacrylate, dodecyl acrylate, tridecyl methacrylate, stearyl acrylate and stearyl methacrylate, or by co-polymerizing said at least one monomer with an ethylenically unsaturated monomer.

10. The light-sensitive silver halide photographic material as claimed in claim 9, wherein said high polymer is a copolymer and said ethylenically unsaturated monomer is selected from the group consisting of an olefin, an acrylic acid or methacrylic acid ester, an acrylamide, styrene or a substituted styrene, and acrylonitrile.

11. The light-sensitive silver halide photographic material as claimed in claim 1 or 3, wherein at least one light-sensitive silver halide emulsion layer is provided on the front side of the support, and on the back side of the support, there are provided (i) at least one layer containing a hydrophobic polymer and (ii) at least one said light-insensitive layer, said layer (i) being located nearer to the support than said layer (ii).

12. The light-sensitive silver halide photographic material as claimed in claim 1 or 3, wherein, on the back side of the support, there are provided (i) at least one said light-insensitive layer which also contains a hydrophobic polymer and (ii) at least one layer containing an antistatic agent, said layer (ii) being located nearer to the support than said layer (i).

13. The light-sensitive silver halide photographic material as claimed in claim 1 or 3, wherein, on the back side of the support, there are provided (i) at least one said light-insensitive layer containing further a hydrophobic polymer and (ii) at least one layer containing an antistatic agent and a hydrophobic polymer, said layer (ii) being located nearer to the support than said layer (i).

14. The light-sensitive silver halide photographic material as claimed in claim 1 or 3, wherein, on the back side of the support, there are provided (i) at least one said light-insensitive layer and (ii) at least one layer containing an antistatic agent and a hydrophobic polymer, said layer (ii) being located nearer to the support than said layer (i).

15. The light-sensitive silver halide photographic material as claimed in claim 9, wherein said high polymer comprises at least 50% by weight of the repeating unit.

16. The light-sensitive silver halide photographic material as claimed in claim 10, wherein said high polymer comprises at least 50% by weight of the repeating unit.

* * * * *